US005575162A

United States Patent [19]

Gray et al.

[11] Patent Number: 5,575,162

[45] Date of Patent: Nov. 19, 1996

[54] APPARATUS FOR CONTROLLING TWIST IN A KNITTED FABRIC

[75] Inventors: Ed Gray; Clark Gurganus, both of Greensboro, N.C.

[73] Assignee: Guilford Mills, Inc., Greensboro, N.C.

[21] Appl. No.: 538,718

[22] Filed: Oct. 3, 1995

[51] Int. Cl.[6] ..... D04B 15/88; D04B 35/00

[52] U.S. Cl. ..... 66/151; 66/149 R; 66/153

[58] Field of Search ..... 66/149 R, 151, 66/153, 152

[56] References Cited

U.S. PATENT DOCUMENTS

| | | | |
|---|---|---|---|
| 1,317,151 | 9/1919 | Ballard | 66/149 X |
| 2,405,162 | 8/1946 | Nyhuis . | |
| 2,408,807 | 10/1946 | Norman . | |
| 2,521,258 | 9/1950 | Semotan | 66/153 X |
| 2,751,768 | 6/1956 | Lebocey . | |
| 2,763,145 | 9/1956 | Pierre . | |
| 3,516,268 | 6/1970 | Foreman | 66/149 R |
| 3,640,095 | 2/1972 | Lonati | 66/149 R X |
| 4,287,729 | 9/1981 | Maninni nee Gallichi . | |
| 4,314,462 | 2/1982 | Ducol et al. | 66/152 |
| 4,407,145 | 10/1983 | Lonati . | |
| 4,454,729 | 6/1984 | Lonati . | |
| 4,576,019 | 3/1986 | Keel et al. . | |
| 4,665,720 | 5/1987 | Beconcini et al. . | |
| 5,157,946 | 10/1992 | Egea et al. . | |
| 5,284,033 | 2/1994 | Lonati et al. . | |
| 5,457,967 | 10/1995 | Scherzinger | 66/151 |

FOREIGN PATENT DOCUMENTS

| | | | |
|---|---|---|---|
| 45238 | 5/1888 | Germany | 66/153 |
| 533059 | 9/1931 | Germany | 66/153 |
| 1911855 | 10/1969 | Germany | 66/149 R |
| 2129847 | 1/1973 | Germany | 66/149 R |
| 647258 | 10/1962 | Italy | 66/149 R |

*Primary Examiner*—John J. Calvert
*Attorney, Agent, or Firm*—Shefte, Pinckney & Sawyer

[57] ABSTRACT

An apparatus for controlling twist in a tubular knitted fabric being withdrawn from a circular knitting machine includes an annular twist control member rotatably mounted to the circular knitting machine for disposition within the tube of the fabric. The twist control member is independently rotatable from the other rotational aspects of the circular knitting machine and frictionally imparts counter rotation to the fabric to prevent twist. Optionally, various rotations of the twist control member may be achieved to reduce or impart twist as desired.

21 Claims, 3 Drawing Sheets

APPARATUS FOR CONTROLLING TWIST IN A KNITTED FABRIC

BACKGROUND OF THE INVENTION

The present invention relates broadly to apparatus for controlling the disposition of knitted, tubular fabric being removed from a circular knitting machine. More particularly, the present invention is directed to an apparatus for controlling twist in a tubular knitted fabric as it is being withdrawn from a circular knitting machine.

Circular knitting is often employed to produce jersey fabric rapidly for use in polo shirts, underwear, and other similar jersey apparel. Within a circular knitting machine, a multiplicity of needles arranged in a circular pattern around the perimeter of a hollow cylinder are fed from an array of yarn packages. The cylinder rotates and the needles are typically cam driven in a predetermined pattern for knitting. The resultant fabric is a knitted, tubular construction and is withdrawn from under the needle cylinder and wound on a rotating mandrel. The mandrel typically rotates about its own longitudinal axis to wind the fabric and it rotates about a vertical axis coincident with the axis of rotation of the needle cylinder to prevent the fabric from twisting into a knotted rope as it is withdrawn from the needle cylinder.

Due to the traverse distance between the wind-up mandrel and the fabric emission portion of the needle cylinder, the knitted fabric can develop a slight twist which has detrimental effects on the finished product. As the tubular fabric is rolled onto the mandrel, creases are inherently formed at the selveges defined by the roll. It would be ideal if the selveges were parallel with the wale of the fabric. However, due to the twist, the wale of the fabric can cross over the selvege, resulting in fabric which is difficult to work. If the net resultant wale of the fabric is out of alignment with the selvege, it becomes more difficult to align sleeves and legs in garments and causes problems with dyeing and other finishing operations.

Therefore, a need exists to control twist of tubular knitted fabric as it is being withdrawn from a circular knitting machine.

SUMMARY OF THE INVENTION

It is accordingly an object of the present invention to provide an apparatus to control twist imposed on a tubular knitted fabric as it is being withdrawn from a circular knitting machine.

It is another object of the present invention to provide such an apparatus that can add or subtract varying, controlled degrees of twist with regard to the tubular knitted fabric.

To that end, an apparatus for controlling twist in a knit fabric being withdrawn from a circular knitting machine is disclosed by the present invention. The apparatus is operable on knitted fabric being withdrawn from a circular knitting machine with the fabric being generally tubular to define a cavity within the fabric. The fabric includes an inner surface and an outer surface. Accordingly to the preferred embodiment of the present invention, the apparatus includes a twist control member rotatably mounted to the circular knitting machine for rotatable disposition within the fabric cavity, with the twist control member having a fabric contact surface. The present invention further includes an assembly for rotatably driving the twist control member be formed as an assembly for controlling the driven rotation of the twist control member. It is preferred that the twist control member be formed as an annular member having the fabric contact surface disposed about an outer periphery thereof for frictionally engaging the fabric and controlling the twist thereof due to relative motion between the fabric and the twist control member.

It is preferred that the fabric be taken up on a rotatable mandrel, with the mandrel being rotatably driven by a mandrel driving apparatus about a first axis extending longitudinally with respect to the mandrel and a second axis extending orthogonally to the first axis and generally vertically with respect to the circular knitting machine, the mandrel rotation causing the fabric to tend to twist about the second axis as the fabric is being taken up.

The twist control member is driven by a driving assembly operable separately from the mandrel driving apparatus. Preferably, the twist control member drive assembly includes an electric motor. It is also preferred that the drive assembly include an arrangement for driving the twist control member in one of a counterclockwise direction and a clockwise direction.

Preferably, the control assembly includes an arrangement for controlling the rotational speed of the twist control member relative to a rotational speed of the mandrel. Further, the control assembly may include an arrangement for changing the rotational speed of the twist control member relative to a rotational speed of the mandrel about the second axis. The control assembly includes an arrangement for controlling the rotational speed of control member and may include a preprogrammed computer. If a preprogrammed computer is applied, it is preferred that the computer be configured to control the speed and direction of rotation of the twist control member relative to the rotational speed and direction of the mandrel.

It is further preferred that the present invention include a fabric opening member disposed adjacent the twist control member to open the fabric cavity to allow the twist control member to engage and act upon the fabric under a predetermined amount of inwardly directed fabric pressure. Preferably, the fabric opening member is formed as a framed structure having an outermost extent extending beyond the outermost diametrical extent of the twist control member for engagement with the inner fabric surface.

By the above, the present invention provides an apparatus which can be used to eliminate or otherwise control twist in a tubular knitted fabric being withdrawn from a circular knitting machine. Since the fabric control member is independently rotatable with respect to the mandrel and the needle cylinder, the relative speed of the mandrel/needle cylinder on one hand and the fabric control member on the other provides the ability to impart controlled twist to the fabric for special fabric effects.

DESCRIPTION OF THE PREFERRED EMBODIMENT

Figure 1:
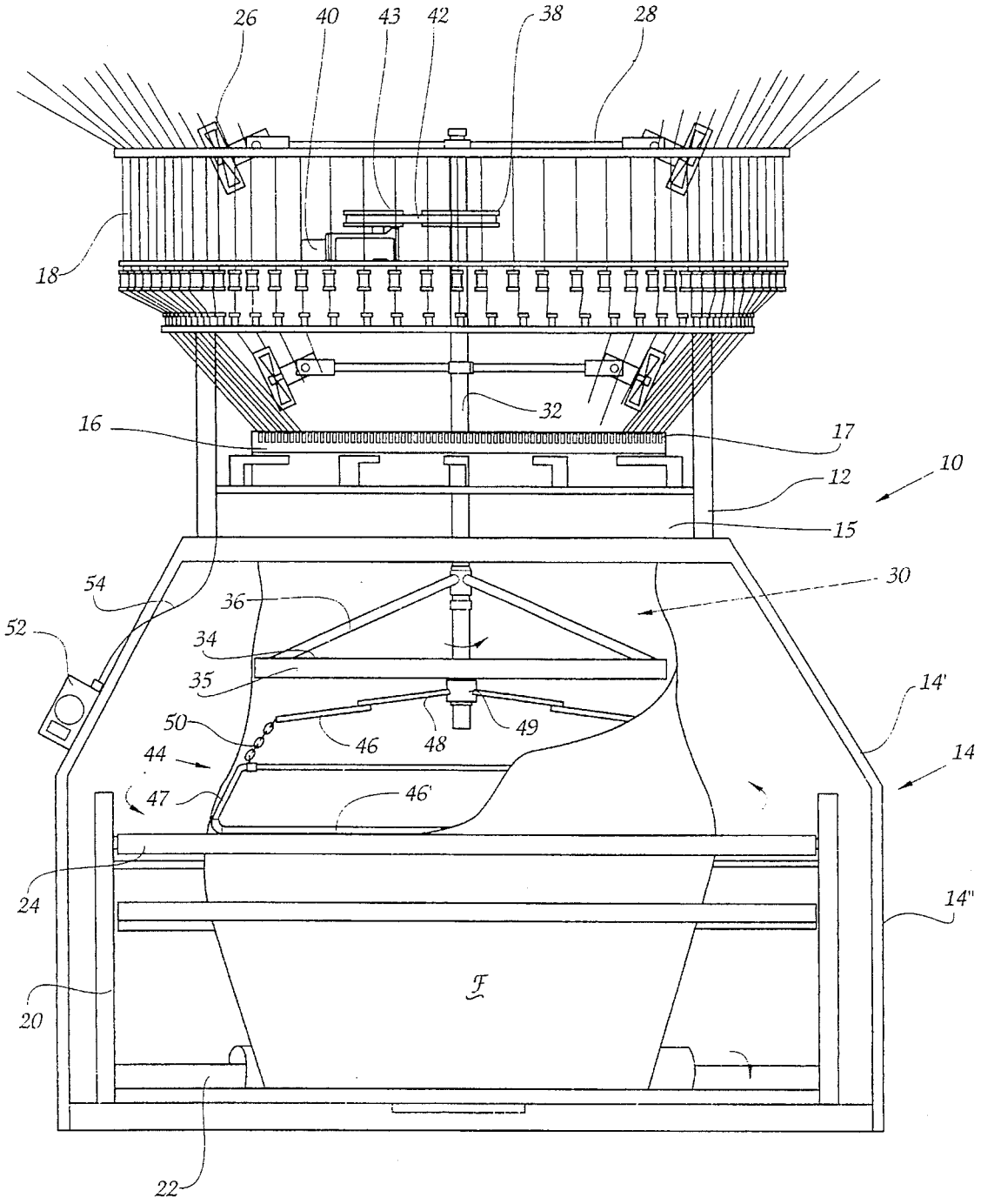
FIG. 1 is a side elevational view of a circular knitting machine being fitted with a twist control assembly according to a preferred embodiment of the present invention and with the fabric being withdrawn shown broken open to reveal the structure of the twist control assembly.

Turning now to the drawings, and more particularly to FIG. 1, a circular knitting machine fitted with the present invention is illustrated generally at 10 and includes an upright frame structure including a lower frame 14 and an upper frame superstructure 12. The lower frame 14 is formed from steel cross members arranged in a generally circular pattern and including a somewhat frusto-conical portion 14' disposed on top of a generally cylindrical portion 14". The framework is skeletal and is typically covered by a wire mesh (not shown) for safety. The superstructure 12 projects upwardly from atop the frusto-conical portion 14' of the lower frame 14. The superstructure 12 is likewise formed from various steel support members and includes a primary support ring 15 disposed intermediate the superstructure 12 and the lower frame structure 14. An annular needle cylinder 16 is disposed within the support ring 15 for driven rotation therein. A plurality of latch-type needles 17 are disposed within the needle cylinder 16 and are driven into operation by the rotating needle cylinder 17. A plurality of individual yarn strands 18 are fed from a yarn supply (not shown) into a threading alignment arrangement which presents the thread to the needles 17 for knitting. In order to maintain dust control within the machine, a plurality of fans 26 are disposed in a spaced, oppositely-directed relationship along fan mounting arms 28 which are in turn attached to a central shaft 32 extending downwardly from the uppermost portion of the machine down into a fabric receiving cavity within the lower frame 14. The fans 26 are propelled around the yarn feeding area for cleaning purposes.

As seen in FIG. 1, fabric F is formed as a knitted tube and is wound on a rotating mandrel 22 which is supported within a mandrel frame 20 that is formed as a generally rectangular open skeletal frame structure. Nip rollers 24 are provided to close the fabric prior to take-up on the mandrel 22. The entire mandrel frame 20 rotates with the needle cylinder 17 to take up the finished fabric product.

Figure 2:
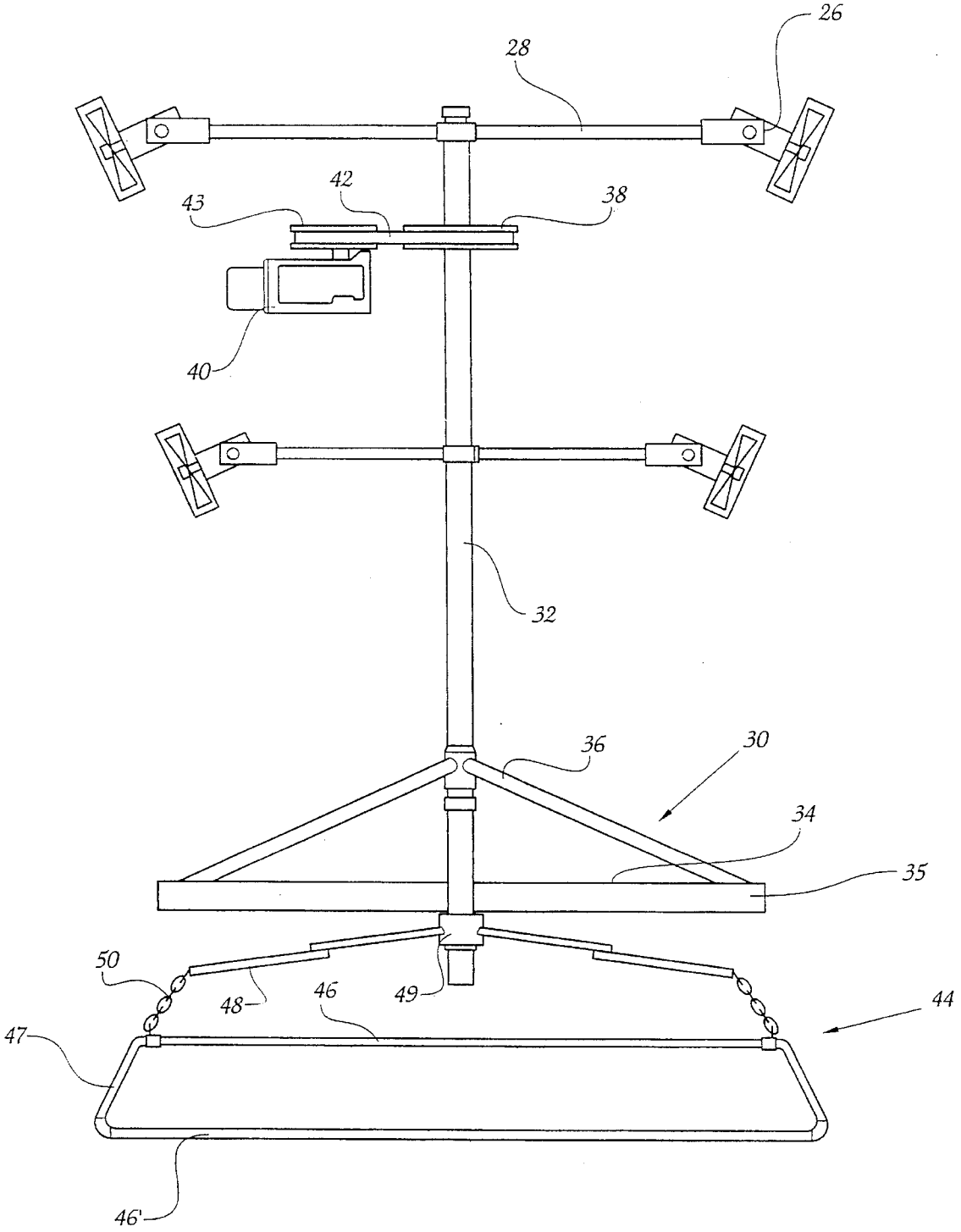
FIG. 2 is a side elevational view of a fabric control mechanism according to the present invention.
Figure 3:
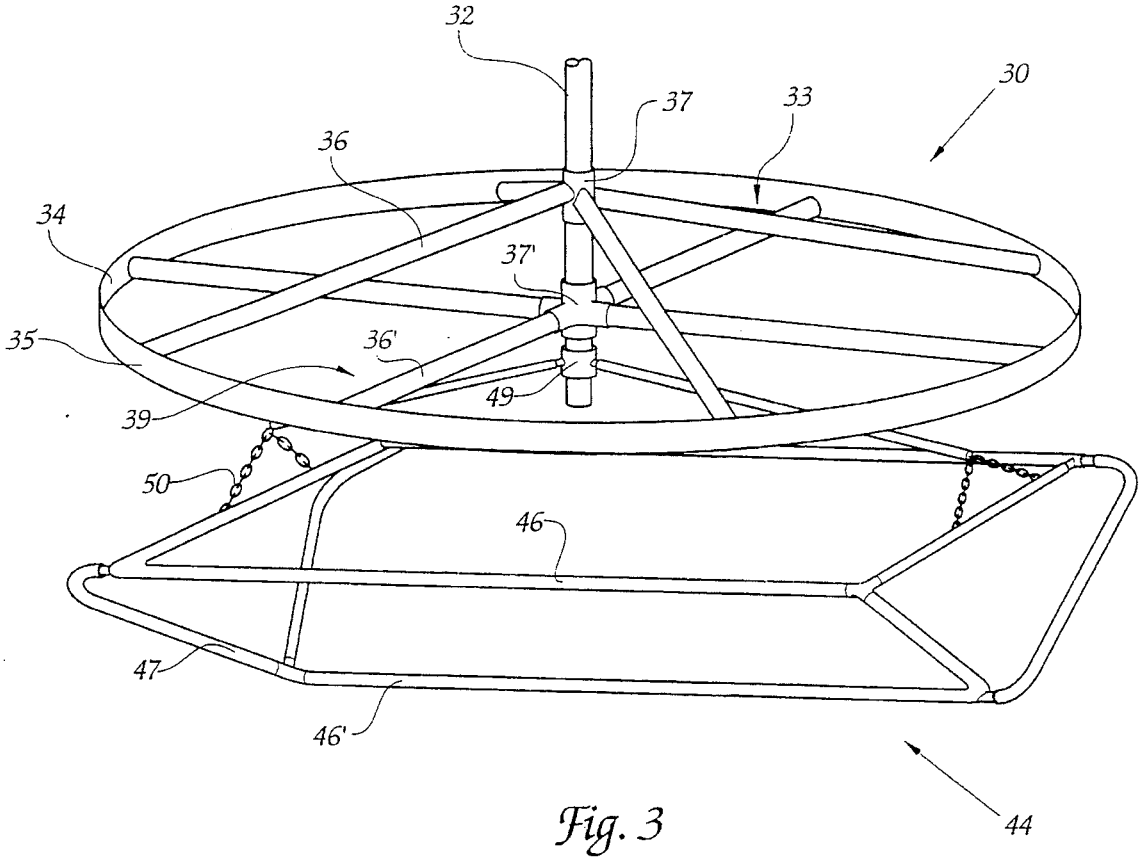
FIG. 3 is a perspective view of the fabric control member and the fabric spreader of the present invention.

The twist control assembly 30 of the present invention is disposed within the lower frame structure 14 and is mounted to the central shaft 32 extending from the lower frame structure 14 upwardly into the superstructure 12. As best seen in FIGS. 2 and 3, the twist control mechanism of the present invention is illustrated generally at 30 and includes an annular twist control member 34 which is formed as a hoop having a vertically oriented outer surface 35 for fabric contact. The twist control member 34 is attached to the drive shaft 32 using a plurality of radially extending cross members 36 which are formed generally as tubular members extending from the inner surface of the twist control member 34 to a central hub 37 attached to the drive shaft 32. Two such bracing arrangements are provided with an upper bracing assembly 33 having angled support members 36 which intersect the drive shaft 32 at a position vertically disposed from the twist control member 34 and a lower bracing assembly 39 which includes bracing members 36 which extend radially inwardly along the plane of the twist control member 34 to another central hub 37' which is also attached to the drive shaft 32. The polar spacing of the bracing members 36,36' is staggered around the twist control member 34 such that braces 36,36' are evenly distributed around the twist control member 34 for strength and balance.

The outer surface 35 of the twist control member is preferably formed of PTFE or other plastic material. While such material may initially seem too smooth to have a controlling effect on the fabric, in reality very little friction is required to impart or retard twist to the traveling fabric. Therefore, such relatively smooth surfaces can provide sufficient friction for proper operation and do not snag or otherwise damage the finished product.

A fabric spreader assembly is also provided to allow smooth closure of the fabric tube F after operation thereon by the twist control member 30. If the fabric were taken straight to the mandrel 22 from the twist control member 30, fabric damage could result due to the tendency of the fabric to close immediately underneath the twist control member 30. Therefore, the fabric spreader 44 is provided. The fabric spreader 44 is a frame-like structure having two triangular end portions 47 with the point of the triangle facing downwardly. Each corner of each triangle is connected by horizontally-oriented cross members 46,47, the overall length of which is greater on a lower cross member 46' than on an upper cross member 46. This causes the end portions 47 to be angled outwardly along a lower portion thereof. The upper cross members 46 are formed with a length that is essentially the same as the diameter of the twist control member 30. The lower cross members 46' are somewhat longer. This allows smooth fabric transition from the twist control assembly 30 to the mandrel 22. The framework of the fabric spreader 44 is suspended by conventional chains 50 or other flexible support members which extend from an end portion 47 to braces 48 which extend radially inwardly to the drive shaft 32. The braces are attached to a hub 49 which is mounted with bearings to allow the drive shaft to rotate within the hub 49 without driving the hub 49. Therefore, the fabric spreader 44 may rotate with the fabric separately from the twist control member 34. By using the fabric spreader 44, the twist control member 30 encounters a substantially horizontally-oriented fabric tube and can therefore operate more effectively.

In order to drive the drive shaft 32 into rotation, a motor, belt, and pulley arrangement is provided. As best seen in FIG. 1, an electric motor 40 is mounted to the superstructure 12 of the circular knitting machine 10 adjacent the upper portion of the drive shaft 32. A pulley 38 and a corresponding pulley 43 are mounted to the drive shaft 32 and the motor 40 respectively. An endless belt 42 allows rotation of the motor pulley 43 to cause rotation of the drive shaft pulley 38, thereby rotating the drive shaft 32. With reference to FIG. 1, the motor 40 is controlled by a controller 52 through conventional wiring 54. The controller 52 may be in the form of a simple switch and rheostat system or may be more complex in the nature of a preprogrammed computer. It is important to note that the motor 40 which drives the twist control assembly 30 is separate and distinct from the motors that operate the knitting cylinder 16 and the mandrel 22. This allows the twist control assembly to be rotated independently of the actual knitting operation.

In operation, as the thread 18 is knitted into fabric F by the needles 17 in the rotating needle cylinder 16, the resultant tubular fabric F is taken up on the mandrel 22. The controller 52 is activated to excite the twist control motor 40 into operation, thereby causing rotation of the twist control member 34. As the fabric F travels over the rotating twist control member 34, a torque is imparted to the fabric tube which is opposite to that of the natural twist of the fabric F, caused by mandrel 22 rotation. In the case of a variable control rheostat, an operator can speed up or slow down the motor 40 in order to compensate for the twist in the fabric, thereby achieving a fabric with no twist at all. Optionally, in some circumstances, a twist is desired in the fabric, i.e., for special fabric effects. To that end, since the twist control member 34 is rotatable independently of the knitting and fabric movement operations, its speed and direction can be utilized to impart a desired twist to the fabric. Further, if a preprogrammed computer is used for the controller 52, a program can determine the degree and direction of twist imparted by speeding up, slowing down, stopping the motor, or changing the direction of rotation. This can also be accomplished through conventional numerical control techniques.

By the above, the present invention provides an apparatus which may be retrofitted to existing circular knitting machines to prevent twist in the fabric produced thereby. The device is mechanically simple and therefore failures of the assembly are unlikely. The present invention provides enhanced productivity with a conventional circular knitting machine without adding unduly to the cost or complexity of the machine.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. An apparatus for controlling twist in a knitted fabric being withdrawn from a circular knitting machine, the circular knitting machine having a motor for driving a knitting cylinder and a fabric take-up assembly, the fabric being generally tubular to define a cavity within the fabric, the fabric having an inner surface and an outer surface, said apparatus comprising:

a twist control member rotatably mounted to the circular knitting machine for rotatable disposition within the fabric cavity, said twist control member having a fabric contact surface;

means for rotatably driving said twist control member; operable independently from the knitting cylinder and take-up assembly drive motor; and means for controlling the driven rotation of said twist control member.

2. An apparatus for controlling twist in a knitted fabric according to claim 1 wherein said twist control member includes an annular member having said fabric contact surface disposed about an outer periphery thereof for frictionally engaging the fabric and controlling the twist therein due to relative motion between the fabric and said twist control member.

3. An apparatus for controlling twist in a knitted fabric according to claim I wherein said driving means includes an electric motor.

4. An apparatus for controlling twist in a knitted fabric according to claim 1 wherein the fabric is taken upon a rotatable mandrel, the mandrel being rotatably driven by a mandrel driving apparatus about a first axis, extending longitudinally with respect to the mandrel and a second axis extending orthogonally to said first axis and generally vertically with respect to said circular knitting machine, the mandrel rotation causing the fabric to tend to twist about the second axis as the fabric is being taken up, said means for rotatably driving said twist control member including an electric motor operable separately from the mandrel driving apparatus.

5. An apparatus for controlling twist in a knitted fabric according to claim 4 wherein said control means includes means for controlling the rotational speed of said twist control member relative to a rotational speed of said mandrel.

6. An apparatus for controlling twist in a knitted fabric according to claim 5 wherein said control means includes means for changing the rotational speed of said twist control member relative to a rotational speed of the mandrel about the second axis.

7. An apparatus for controlling twist in a knitted fabric according to claim 4 wherein said drive means includes means for driving said twist control member in one of a counterclockwise direction and a clockwise direction.

8. An apparatus for controlling twist in a knitted fabric according to claim 1 wherein said control means includes means for controlling the rotational speed of said twist control member.

9. An apparatus for controlling twist in a knitted fabric according to claim 4 wherein said control means includes a preprogrammed computer.

10. An apparatus for controlling twist in a knitted fabric according to claim 9 wherein said computer is configured to control the speed and direction of rotation of the twist control member relative to the rotational speed and direction of said mandrel.

11. An apparatus for controlling twist in a knitted fabric according to claim 1 and further comprising a fabric opening member disposed adjacent said twist control member to open the fabric cavity to allow said twist control member to engage and act upon the fabric under a predetermined amount of inwardly directed pressure.

12. An apparatus for controlling twist in a knitted fabric according to claim 11 wherein said fabric opening member is formed as a framed structure having an outermost extent beyond the outermost diametrical extent of said twist control member for engagement with the inner fabric surface.

13. In a circular knitting machine having a motor for driving a knitting cylinder and a fabric take-up assembly and of the type wherein knitted fabric is formed in a generally tubular configuration defining a cavity within the fabric, the fabric having an inner surface facing into the cavity, the knitting machine further including a rotating mandrel for fabric take-up thereon, the mandrel being rotatable about a first axis extending longitudinally and a second axis extending orthogonally to said first axis, the improvement comprising:

a twist control member rotatably mounted to the knitting machine for rotatable disposition within the fabric cavity, said twist control member having a fabric contact surface for frictional engagement with the inner surface of the fabric;

means for rotatably driving said twist control member operable independently from the knitting cylinder and take-up assembly drive motor; and means for controlling the driven rotation of said twist control member as it frictionally engages the fabric to control the twist of the fabric due to relative motion between the fabric and said twist control member.

14. An improved circular knitting machine according to claim 13 wherein said twist control member is a hoop-like member having said fabric contact surface disposed about an outer periphery thereof.

15. An improved circular knitting machine according to claim 13 wherein said control means includes a preprogrammed computer.

16. An improved circular knitting machine according to claim 15 wherein said computer is configured to control the speed and direction of rotation of the twist control member relative to the rotational speed and direction of said mandrel.

17. An improved circular knitting machine according to claim 13 and further comprising a fabric opening member disposed adjacent said twist control member to open the fabric cavity to allow said twist control member to engage and act upon the fabric under a predetermined amount of inwardly directed pressure.

18. An improved circular knitting machine according to claim 17 wherein said fabric opening member is formed as a framed structure having an outermost extent beyond the outermost diametrical extent of said twist control member for engagement with the inner fabric surface.

19. Apparatus for controlling twist in a knitted fabric being withdrawn from a circular knitting machine, the fabric being generally tubular to define a cavity within the fabric, the fabric having an inner surface and an outer surface, with the fabric being taken up on a rotatable mandrel, the mandrel being rotatable about a first axis extending longitudinally and a second axis extending orthogonally to said first axis, said apparatus comprising:

a twist control member rotatably mounted to the knitting machine, said twist control member having a hoop-like configuration and a fabric contact surface extending along an outer periphery thereof for frictional engagement with the inner surface of the fabric to control the twist thereof;

an electric motor and a drive shaft connecting said electric motor to said twist control member for rotatably driving said twist control member; and means for controlling the direction and speed of rotation of said twist control member relative to rotation of the mandrel to control the twist of the fabric by frictional engagement and relative motion between said fabric contact surface and the inner surface of the fabric.

20. An apparatus for controlling twist in a knitted fabric according to claim 19 and further comprising a fabric opening member disposed adjacent said twist control member to open the fabric cavity to allow said twist control member to engage and act upon the fabric under a predetermined amount of inwardly directed pressure.

21. Apparatus for controlling twist in a knitted fabric according to claim 19 wherein said fabric opening member is formed as a framed structure having an outermost extent beyond the outermost diametrical extent of said twist control member for engagement with the inner fabric surface.

* * * * *